United States Patent [19]

Lavon et al.

[11] 4,129,335

[45] Dec. 12, 1978

[54] FLUID JET METHOD AND DEVICE FOR BREAKING HARD MATERIAL

[75] Inventors: Erik V. Lavon, Saltsjö-Boo, Sweden; Bo Lemcke, Lausanne, Switzerland; Levi J. Karlfors, Nacka, Sweden

[73] Assignee: Atlas Copco Aktiebolag, Nacka, Sweden

[21] Appl. No.: 718,421

[22] Filed: Aug. 27, 1976

[30] Foreign Application Priority Data

Sep. 19, 1975 [SE] Sweden ..... 7510560

[51] Int. Cl.[2] ..... E21C 37/12

[52] U.S. Cl. ..... 299/17; 175/67; 299/95

[58] Field of Search ..... 299/16, 17, 99, 95; 175/67; 239/101

[56] References Cited

U.S. PATENT DOCUMENTS

| | | | |
|---|---|---|---|
| 3,231,031 | 1/1966 | Cleary | 175/67 |
| 3,572,839 | 3/1971 | Okabe | 299/17 |
| 3,988,037 | 10/1976 | Denisart et al. | 299/16 |

FOREIGN PATENT DOCUMENTS

| | | | |
|---|---|---|---|
| 438180 | 11/1967 | Switzerland | 299/16 |
| 897879 | 5/1962 | United Kingdom | 299/16 |
| 235691 | 6/1969 | U.S.S.R. | 299/17 |

*Primary Examiner*—Ernest R. Purser
*Attorney, Agent, or Firm*—Flynn & Frishauf

[57] ABSTRACT

A hard compact material, such as rock, is broken by directing a high velocity jet of fluid, such as water, into a drill hole in the material to be broken. The jet is generated by a nozzle and is directed into the drill hole through a tubular member, which is associated with the nozzle. Upon having traversed the tubular member, the jet is suddenly arrested in the hole to break the material by the established jet stagnation pressure stemmed by the tubular member.

22 Claims, 3 Drawing Figures

FLUID JET METHOD AND DEVICE FOR BREAKING HARD MATERIAL

BACKGROUND OF THE INVENTION

During the last decade serious attention has been given to replacing the drill and blast technique for tunneling, mining and similar operations. One alternative technique involves the use of high velocity jets of water or other liquid to fracture the rock or ore body and numerous devices intended to produce pulsed or intermittent liquid jets of sufficiently high velocity to fracture even the hardest rock have been suggested. Devices of that type are disclosed in for example U.S. Pat. Nos. 3,784,103 and 3,796,371. As yet, however, jet cutting techniques are still unable to compete with the traditional methods of rock breakage such as drill and blast in terms of advance rate, energy consumption or overall cost. Moreover serious technical problems such as the fatigue of parts subjected to pressures as high as 10 or 20 kbar and excessive operational noise remain.

A second, and even older technique for fracturing the rock and for saturating soft rock formations such as coal with water for dust suppression involves drilling a hole in the rock and thereafter pressurizing the hole with water either statically or dynamically. This technique is disclosed in for example German Patent Nos. 230,082, 241,966 and 1,017,563.

These methods are inapplicable to hard rock formations because of the restriction in working pressure which can be realized or usefully utilized with conventional hydraulic pumps. They are difficult to apply in practice particularly in soft crumbling rock or badly fissured rock in that the bore hole must be effectively sealed around the tube introduced into the hole through which the liquid is pumped. These restrictions in all make the method far less versatile than drill and blast.

It is an object of the invention to provide method and means for breaking hard compact material such as rock by pulsed or intermittent jet devices which are operated to hydraulically pressurize holes having been drilled into the material beforehand. Particularly, the present invention seeks to provide method and means of the above mentioned type wherein the generation and driving of the material or rock breaking cracks can be controlled more effectively under the high stagnation pressure created in the hole. Another object of the invention is to improve during operation the alignment of the nozzle with respect to the hole to be pressurized by the liquid jet. A further object is to provide more dependable material or rock fracturing in case of defective configuration of the pre-drilled holes. A still further object is to decrease the noise of the jet by confining jet emission to the interior of the hole.

SUMMARY OF THE INVENTION

For the above and other purposes there is according to one aspect of the invention provided a method of breaking hard compact material, such as rock, characterized by drilling a hole into the material to be broken, extending a tubular member from outside into the hole, generating by a nozzle a high velocity jet of relatively incompressible fluid such as water, directing the jet through the tubular member into the hole, and in appropriate position with respect to adjacent free surfaces of the material suddenly arresting the jet in the hole upon having traversed the tubular member so as to create a jet stagnation pressure stemmed by the tubular member in the hole and of sufficient magnitude and duration or jet repetition rate to break the material towards the free surfaces adjacent the hole.

According to another aspect of the invention there is provided a device for breaking hard compact material such as rock into which a hole has been drilled and incorporating a nozzle having means associated therewith to emit from the nozzle a massive high velocity jet of relatively incompressible fluid such as water to be directed into the hole, the device being characterized by a tubular member fitting in the hole and being associated with the nozzle for defining alignment between the nozzle and the tubular member and between the nozzle and the hole.

Generally, the advantages to be gained by the above method and means are as follows:

(1) The specific energy for rock removal is at least one order of magnitude lower (typical values are 1–10 $MJ/m^3$) than for a jet impacting a flat surface in which there is no hole.

(2) Breakage is more controllable than with a jet impacting a flat surface, in which there is no hole, the fragmentation depending on the depth of the hole, the shape of the bottom of the hole and the location of the hole relative to the free surfaces or corners of the rock or material to be broken.

(3) The jet velocity necessary to break a given material is lower (typically less than 2000 m/sec) than for a jet impacting a flat surface in which there is no hole. Since the maximum pressure generated in the machine depends on the jet velocity this means that the machine is less liable to fatigue or similar mechanical problems. Typical working pressures are less than 5 kbar.

(4) Since the noise of the jet is related to its velocity the above reduction in velocity also leads to more silent operation.

Particularly, the advantages to be gained by the present method and means are derived from the novel application of the tubular member which allows positive alignment of the nozzle with the hole, defines the predomination driving direction of the cracks, and confines the action of the stagnation pressure to the depth of the hole while stemming the outer portions thereof against excessive pressure and leakage.

BRIEF DESCRIPTION OF THE DRAWINGS

Two embodiments of the invention will now be described by way of example with reference to the accompanying drawings, in which.

DETAILED DESCRIPTION

Figure 1:
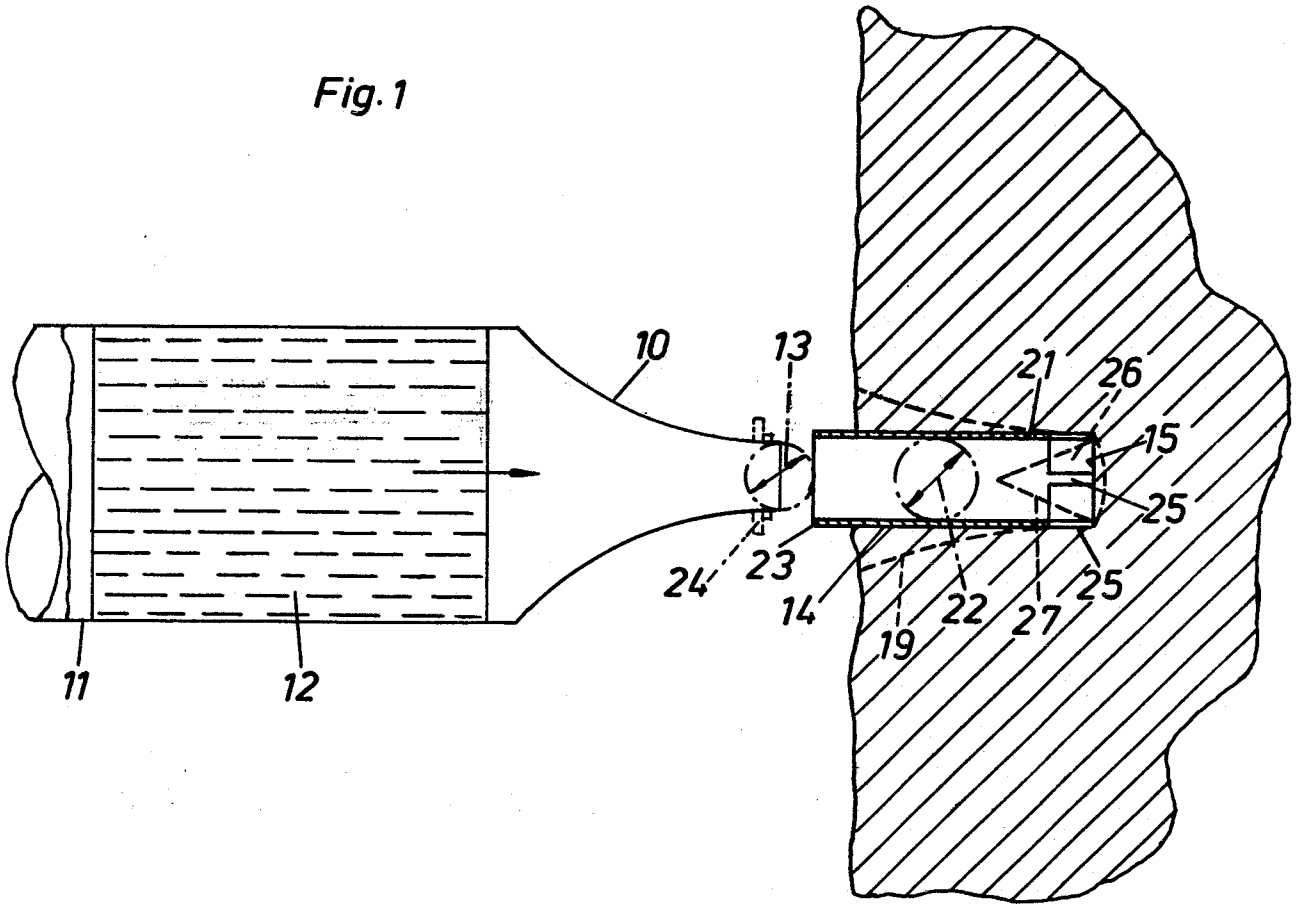
FIG. 1 is a diagrammatic fragmentary view mainly in section of a jet nozzle shown directed towards a hole in a rock face to be broken by the method according to one embodiment of this invention.

In FIG. 1 a nozzle 10 forms part of a jet generator 11, not illustrated in detail, wherein a relatively incompressible fluid such as water 12 is operated upon by an accelerating pressure fluid, such as compressed air, by piston impact or by other means to provide a high velocity jet out through free cross section 13 of the nozzle 10. The jet generator may be of any suitable conventional type for example of the pulsed liquid jet type as exemplified in U.S. Pat. Nos. 3,784,103 and 3,796,371 and in Bulletin of the JSME, Vol. 18, No. 118, April 1975, pages 358, 359. If several jet pulses in the same hole are needed at high jet repetition rate to fracture the rock satisfactorily, then a device similar to U.S. Pat. No. 3,883,075 may be used.

In the face of the material of rock to be worked away by incremental fracturing there are drilled bottom holes 14 at suitably chosen intervals, preferably 5 to 10 diameters deep. The hole bottom is designated 15. The holes are drilled in any suitable conventional way for example by rotary drilling or combined rotary and percussive drilling.

In the embodiment depicted in FIG. 1 a tubular member 21, preferably a metallic liner, has been inserted to extend from outside to proximity of the bottom 15 of the hole 14. For easy insertion in the holes to be pressurized by the nozzle 10 the liners 21 are to have sufficient clearance in the holes 14. The free cross section of the liner 21 is designated 22 and tongues or lugs 25 at the inner end of the liner 21 provide a spacing whereby lateral free openings 26 are maintained at the bottom 15 of the hole 14 for the jet action. Preferably at the mouth or rear end of the liner 21 serves as a centering seat 23 for a flange 24 on the nozzle 10 so as to establish coaxiality between the nozzle 10 and the liner 21 when the jet is to be fired into the hole.

Figure 3:
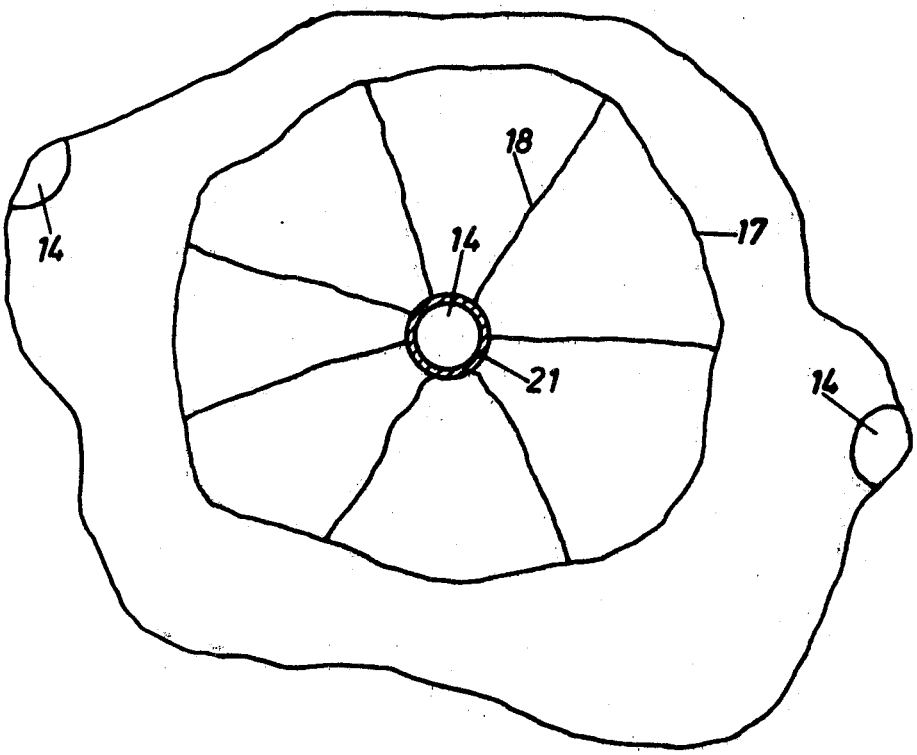
FIG. 3 is a fragmentary front view of the hole arrangement in FIG. 1 or 2 illustrating a characteristic crack pattern produced during breaking.

With the liner 21 in place in the hole 14, FIG. 1, the nozzle 10 in operation is aligned with the hole 14 by applying the flange 24 thereof against the mouth seat 23. The jet generator 11 is then fired to pulse a high velocity water jet into the liner 21 of hole 14. The jet is arrested suddenly by bottom 15 whereby a jet stagnation pressure is built up in the hole of sufficient magnitude (in the order of several kilobars) to initiate and thereafter drive cracks on the region of the hole bottom 15 and the openings 26 of the liner 21. The liner 21 in itself, peripherally supported by the pressure drop in the liquid leaking out through the clearance around the liner, provides a stemming of the hole during the time necessay to finish driving the rock fracturing cracks. This time is normally in the order of 0.1–1 milliseconds but may be shorter if one chooses to fire by way of repetition a rapid sequence of jet shots into the hole in order to complete the driving of the cracks. The material or rock is typically broken away by mushroom-type cracks 17, FIG. 3, and radial cracks 18 directed towards the free surfaces of the material or rock face adjacent the pressurized hole 14. The nozzle is thereafter aligned with and a water jet fired into the next adjacent hole 14 and so on thereby working away the rock. The liner 21 offers an ideal hole configuration for the jet action and thus reduces the negative influence a defective hole configuration 19 may have on the operation. For improved crack initiation in the preferred directions, a deflector plug 27 may be provided as a bottom for the liner 21 so as to deflect the jet laterally towards the openings 26.

Satisfactory breakage can be obtained for water jets whose cross section diameter 13 is chosen between 30% and 100% of the diameter 22 of the free cross section of the hole 14 (liner 21), with preference for values near 100%. The preferred jet velocity is in the order of 2000 m/sec. The diameter and depth of the hole to be drilled beforehand depends on the type and quality of the material or rock and the size of fragments to be removed.

Figure 2:
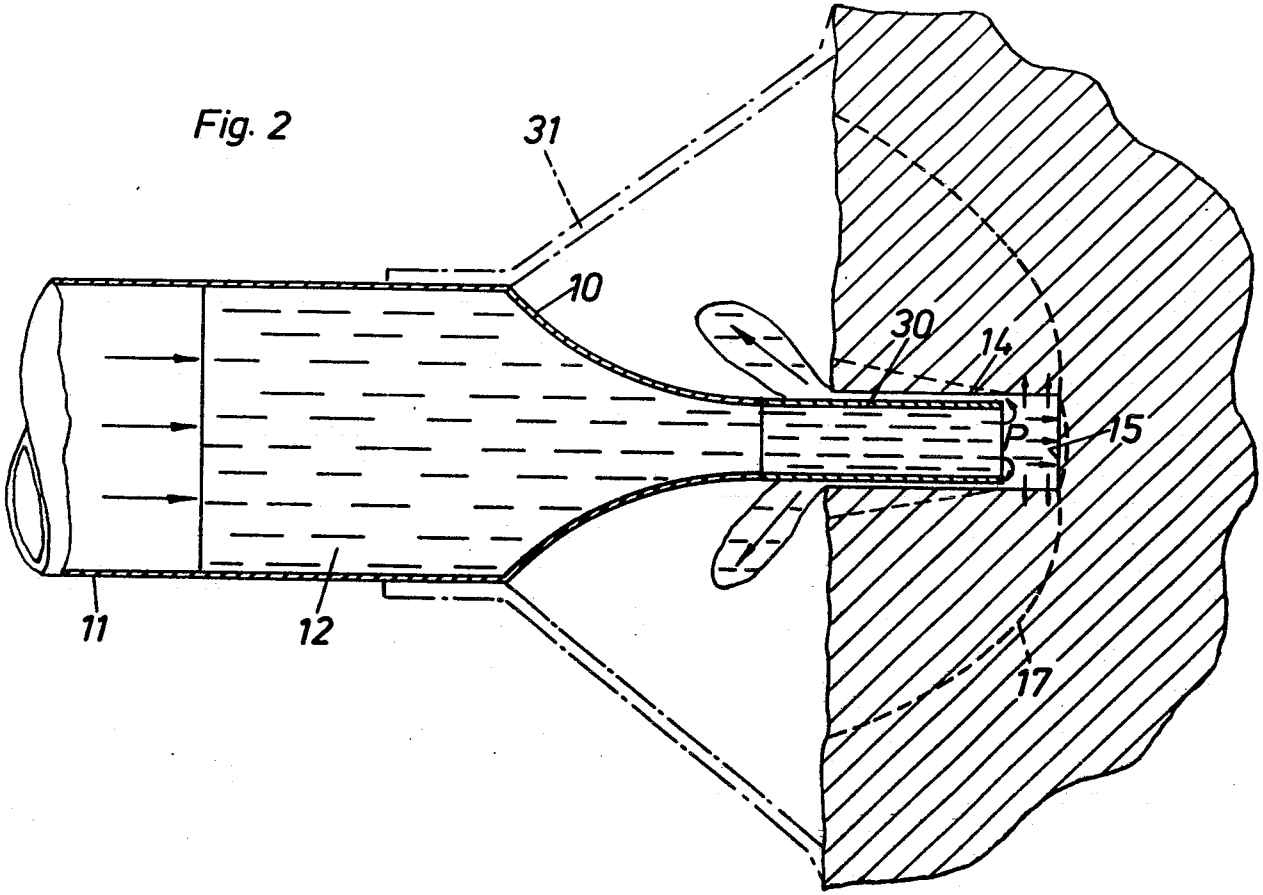
FIG. 2 is a view corresponding to FIG. 1 but illustrating diagrammatically another embodiment of this invention during actual material or rock breaking.

In the embodiment shown in FIG. 2 the tubular member or liner 30 forms an integral coaxial continuation of the nozzle 10. This provides simplified handling during operation since the nozzle and the liner are moved as a single unit from hole to hole. The forward end portion of the liner 30 may be similar to the one of liner 21 in FIG. 1. A hood 31 of suitable conventional type for combating noise and flying splinters may be provided around the nozzle and has preferably a resilient edge contact with the face of the rock around the portion thereof to be cracked and broken.

What we claim is:

1. A method of breaking a hard compact material, such as rock comprising:

mechanically drilling a substantially cyclindrical blind hole in the material to be broken, said material having free surfaces adjacent said hole;

extending a tubular member into said hole from outside said hole, said tubular member having an open forward end which faces the bottom of said hole;

generating a high velocity jet of substantially incompressible fluid through a nozzle having an internal cavity which has a converging contour leading to a nozzle exit area, the smallest cross sectional dimension of said jet being between 30–100% of the free cross sectional diameter of said tubular member; and directing said jet from said nozzle exit area and through said tubular member toward the bottom of said hole so as to be suddenly arrested upon impact with said hole bottom after having traversed said tubular member to create a jet stagnation pressure in said hole, stemmed by said tubular member, to break said material toward said adjacent free surfaces of said material.

2. A method according to claim 1, in which said hole is drilled 5 to 10 diameters deep, said tubular member is extended to the proximity of the bottom of said hole, and said jet stagnation pressure is created by directing said jet toward the bottom of said hole so as to be arrested thereby.

3. The method of claim 1 comprising deflecting said jet towards a wall of said hole.

4. The method of claim 1 wherein said jet has a cross section diameter substantially equal to the diameter of said free section of said tubular member.

5. The method of claim 1 wherein said tubular member is extended coaxially and integrally with said nozzle.

6. The method of claim 1 wherein said tubular member has an outer diameter substantially the diameter of said hole.

7. The method of claim 1 wherein said jet which is directed through said tubular member has a sufficient magnitude and duration to create said jet stagnation pressure in said hole to break said material towards said adjacent free surfaces of said material.

8. The method of claim 1 comprising generating said jet which is directed through said tubular member at a predetermined repetition rate sufficient to break said material towards said adjacent free surfaces of said material.

9. The method of claim 1 comprising storing a quantity of said substantially incompressible fluid outside of said hole and supplying same to said nozzle.

10. The method of claim 1 comprising mechanically drilling said blind hole with a substantially sharp transition between the bottom and side walls thereof in order to produce substantially local stress concentration for the initiation of cracks in the vicinity of said transition under the influence of said jet stagnation pressure.

11. A method according to claim 1, wherein said high velocity jet is generated through a nozzle having an internal cavity which has a continuously converging contour which leads to said nozzle exit area.

12. Apparatus for breaking a hard compact material, such as rock, having a substantially cylindrical blind hole formed therein, comprising a nozzle having an internal cavity which has a converging contour leading to a nozzle exit area;

means operatively associated with said nozzle to emit a massive high velocity jet of substantially incompressible fluid from said nozzle exit area; and a tubular fluid directing and stemming member operatively associated with said nozzle to receive said jet from said nozzle exit area, said tubular member being in alignment with said nozzle and said hole, said tubular member at least partially extending into said hole from outside said hole and extending further into said hole than said nozzle exit area, and having an open forward end facing the bottom of said hole, said tubular member having interior surface means for receiving and directing said jet from said nozzle exit area toward said bottom of said hole upon said jet having traversed said tubular member.

13. The apparatus of claim 12 wherein said tubular member has a rear end which receives said nozzle and provides a centering seat for said nozzle.

14. The apparatus of claim 12 wherein said tubular member is coaxial with said nozzle and forms an integral part thereof.

15. The apparatus of claim 14 wherein said tubular member has a length so as to extend into said hole to the proximity of the bottom of said hole with said nozzle disposed at the mouth of said hole.

16. The apparatus of claim 12 further comprising a deflector at the forward end of said tubular member for lateral deflection of said jet.

17. The apparatus of claim 12 wherein said nozzle and said means operatively associated therewith generate said jet having a smallest cross sectional dimension of between 30–100% of the free cross sectional diameter of said tubular member.

18. The apparatus of claim 12 wherein said means operatively associated with said nozzle causes said nozzle to emit said jet of sufficient magnitude and duration to create a jet stagnation pressure upon sudden arresting of said jet upon impact with said hole bottom to break said material toward adjacent free surfaces of said material.

19. The apparatus of claim 12 wherein said means operatively associated with said nozzle causes said nozzle to emit said jet having a predetermined repetition rate sufficient to create a jet stagnation pressure in said hole upon said jet being arrested upon impact with said hole bottom to break said material towards adjacent free surfaces of said material.

20. The apparatus of claim 12 wherein said tubular member has a sufficient length so as to extend into said hole to the proximity of the bottom of said hole.

21. The apparatus of claim 12 wherein said tubular member has a rear end which receives said nozzle and which provides a centering seat for said nozzle, and said nozzle has a flange therearound to cooperatively engage said centering seat of said tubular member.

22. The apparatus of claim 12, wherein said internal cavity of said nozzle has a continuously converging contour which leads to said nozzle exit area.

* * * * *